US006023672A

United States Patent [19]

Ozawa

[11] Patent Number: 6,023,672

[45] Date of Patent: Feb. 8, 2000

[54] SPEECH CODER

[75] Inventor: Kazunori Ozawa, Tokyo, Japan

[73] Assignee: NEC Corporation, Tokyo, Japan

[21] Appl. No.: 08/840,801

[22] Filed: Apr. 16, 1997

[30] Foreign Application Priority Data

Apr. 17, 1996 [JP] Japan ..... 8-095412

[51] Int. Cl.[7] ..... G10L 5/00

[52] U.S. Cl. ..... 704/222; 704/230; 704/219; 704/220

[58] Field of Search ..... 704/222, 230, 704/219, 212, 264, 503, 504, 220

[56] References Cited

U.S. PATENT DOCUMENTS

| | | | |
|---|---|---|---|
| 3,908,087 | 9/1975 | Krol | 704/211 |
| 4,724,535 | 2/1988 | Ono | 704/230 |
| 4,881,267 | 11/1989 | Taguchi | 704/504 |
| 4,945,565 | 7/1990 | Ozawa et al. | 704/223 |
| 5,060,268 | 10/1991 | Asakawa et al. | 704/230 |
| 5,265,167 | 11/1993 | Akamine et al. | 704/503 |
| 5,307,441 | 4/1994 | Tzeng . | |
| 5,642,465 | 6/1997 | Scott et al. | 704/219 |
| 5,651,090 | 7/1997 | Moriya | 704/222 |
| 5,717,825 | 2/1998 | Lamblin | 704/219 |
| 5,826,226 | 10/1998 | Ozawa | 704/223 |

FOREIGN PATENT DOCUMENTS

| | | |
|---|---|---|
| 0 360 265 | 3/1990 | European Pat. Off. . |
| 4-17150 | 6/1992 | Japan . |
| 4-363000 | 12/1992 | Japan . |
| 5-6199 | 1/1993 | Japan . |
| WO 95/30222 | 11/1995 | WIPO . |

OTHER PUBLICATIONS

Kataoka et al., "CS–ACELP Standard Algorithms", NTT R&D, No. 4, vol. 45, PP325–330 (Apr. 10, 1996).

Taumi et al., "Low–Delay CELP with Multi–Pulse VQ and Fast Search for GSM EFR".

Laflamme et al., "16 KBPS Wideband Speech Coding Technique Based on Algebraic CELP".

M.R. Schroeder et al., "Code–Excited Linear prediction (CELP): High–Quality Speech at Very Low Bit Rates", *Proc. ICASSP,* 1985, pp. 937–940.

W.B. Kleijn et al., "Improved Speech Quality and Efficient Vector Quantization in SELP", *Proc. ICASSP,* 1988, pp. 155–158.

C. Laflamme et al., "16 KBPS Wideband Speech Coding technique Based on Algebraic CELP", *Proc. ICASSP,* 1991, pp. 13–16.

T. Nomuran et al., "LSP Coding Using VQSVQ with Interpolation in 4.075 kbps M–LCELP Speech Coder", *Proc. Mobile Multimedia Communications,* 1993, pp. B. 2.5.

P. Kroon et al., "Pitch Predictors with high Temporal Resolution", *Proc. ICASSP,* 1990, pp. 661–664.

K. Ozawa, "A Study on Pulse Search Algorithm for Multipulse Excited Speech Coder Realization", *IEEE Jrl on Selected Areas in Comms,* vol. CAC–4, No. 1, Jan. 1986, pp. 133–141.

Y. Linde et al., "An Algorithm for Vector Quantizer Design", *IEEE Transactions on Communications,* vol. COM–28, No. 1, Jan. 1980, pp. 84–95.

*Primary Examiner*—David R. Hudspeth
*Assistant Examiner*—Odniei Abebe
*Attorney, Agent, or Firm*—Sughrue, Mion, Zinn, Macpeak & Seas, PLLC

[57] ABSTRACT

An excitation quantizer 60 in a speech encoder includes a divider, which divides M pulses representing in combination a speech signal into groups each of L pulses, L being smaller than M. The amplitude of pulses, i.e., L pulses as each unit, is quantized, using spectral parameter. The quantization is executed on at least one quantization candidate, which is selected through distortion evaluation made through addition of the evaluation value based on an adjacent group quantization candidate output value and the evaluation value based on the pertinent group quantization value.

7 Claims, 6 Drawing Sheets

SPEECH CODER

BACKGROUND OF THE INVENTION

The present invention relates to a speech coder for high quality coding speech signal at a low bit rate.

As a system for highly efficiently coding speech signal, CELP (Code Excited Linear Prediction Coding) is well known in the art, as disclosed, in for instance, M. Schroeder and B. Atal, "Code-excited linear prediction: high quality speech at very low bit rates", Proc. ICASSP, pp. 937–940, 1985 (Literature 1), and Kleijn et. al, "Improved speech quality and efficient vector quantization in SELP", Proc. ICASSP, pp. 155–158, 1998 (Literature 2). In these well-known systems, on the transmitting side spectral parameters representing a spectral characteristic of a speech signal is extracted from the speech signal for each frame (of 20 ms, for instance)through LPC (Linear prediction) analysis. Also, the frame is divided into sub-frames (of 5 ms, for instance), and parameters in an adaptive codebook (i.e., a delay parameter and a gain parameter corresponding to the pitch cycle) are extracted for each sub-frame on the basis of the past excitation signal, for making pitch prediction of the sub-frame noted above with the adaptive codebook. For quantizing the optimum gain, the optimum gain is calculated by selecting an optimum excitation codevector from an excitation codebook (i.e., vector quantization codebook) consisting of noise signals of predetermined kinds for the speech signal obtained by the pitch prediction. An excitation codevector is selected so as to minimize the error power between a synthesized signal from the selected noise signals and the error signal. An index representing the kind of the selected codevector and gain data are sent in combination with the spectral parameter and the adaptive codebook parameters noted above. The receiving side is not described.

The above prior art systems have a problem that a great computational effort is required for the optimum excitation codevector selection. This is attributable to the facts that in the systems shown in Literatures 1 and 2 filtering or convolution is executed for each codevector, and that this computational operation is executed repeatedly a number of times corresponding to the number of codebooks stored in the codebook. For example, with a codebook of B bits and N dimensions, the computational effort required is $N \times K \times 2^B \times 8{,}000/N$ (K being the filter or impulse response length in the filtering or convolution). As an example, when B=10, N=40 and K=10, 81,920,000 computations per second are necessary, which is very enormous.

Various systems have been proposed to reduce the computational effort required for the excitation codebook search. For example, an ACELP (Algebraic Code Excited Linear Prediction) has been proposed. For this system, C. Laflamme et. al, "16 kbps wide band speech coding technique based on algebraic CELP", Proc. ICASSP, pp. 13–16, 1991 (Literature 3), for instance, may be referred to. In the system shown in Literature 3, an excitation signal is represented by a plurality of pulses, and the position of each pulse is represented by a predetermined number of bits for transmission. The amplitude of each pulse is limited to +1.0 or −1.0, and it is thus possible to greatly reduce the computational effort for the pulse search.

In the prior art system shown in Literature 3, the speech quality is insufficient although it is possible to greatly reduce the computational effort. This is so because each pulse has only a positive or negative polarity, and the absolute amplitude of the pulse is always 1.0 regardless of the pulse position. This means that the amplitude is quantized very coarsely, and therefore the speech quality is inferior.

SUMMARY OF THE INVENTION

An object of the present invention is therefore to provide a speech coder, which can solve problems discussed above, and in which the speech quality is less deteriorated with a relatively less computational effort even when the bit rate is low.

According to an aspect of the present invention, there is provided a speech coder comprising a spectral parameter calculator for obtaining a spectral parameter from an input speech signal and quantizing the spectral parameter, a divider for dividing M non-zero amplitude pulses of an excitation signal of the speech signal into groups each of pulses smaller in number than M, and an excitation quantizer which, when collectively quantizing the amplitudes of the smaller number of pulses using the spectral parameter, selects and outputs at least one quantization candidate by evaluating the distortion through addition of the evaluation value based on an adjacent group quantization candidate output value and the evaluation value based on the pertinent group quantization value.

According to another aspect of the present invention, there is provided a speech coder comprising a spectral parameter calculator for obtaining a spectral parameter from an input speech signal and quantizing the spectral parameter, and an excitation quantizer including a codebook for dividing M non-zero amplitude pulses of an excitation signal into groups each of pulses smaller in number than M and collectively quantizing the amplitude of the smaller number of pulses, the excitation quantizer calculating a plurality of sets of positions of the pulses and, when collectively quantizing the amplitudes of the smaller number of pulses for each of the pulse positions in the plurality of sets by using the spectral parameter, selecting at least one quantization candidate by evaluating the distortion through addition of the evaluation value based on an adjacent group quantization candidate output value and the evaluation value based on the pertinent group quantization value, thereby selecting a combination of a position set and a codevector for quantizing the speech signal.

According to other aspect of the present invention, there is provided a speech coder comprising a spectral parameter calculator for obtaining a spectral parameter from an input speech signal for every determined period of time and quantizing the spectral parameter, a mode judging unit for judging a mode by extracting a feature quantity from the speech signal, and an excitation quantizer including a codebook for dividing M non-zero amplitude pulses of an excitation signal into groups each of pulses smaller in number than M and collectively quantizing the amplitudes of the smaller number of pulses in a predetermined mode, the excitation quantizer calculating a plurality of sets of positions of the pulses and, when collectively quantizing the amplitude of the smaller number of pulses for each of the pulse positions in the plurality of sets by using the spectral parameter, selecting at least one quantization candidate by evaluating the distortion through addition of the evaluation value based on an adjacent group quantization candidate output value and the evaluation value based on the pertinent group quantization value, thereby selecting a combination of position set and a codevector for quantizing the speech signals.

According to still other aspect of the present invention, there is provided a speech coding method comprising: dividing M non-zero amplitude pulses of an excitation into groups each of L pulses less than M pulses and, when collectively quantizing the amplitudes of L pulses, selecting and outputting at least one quantization candidate by evaluating a distortion through addition of an evaluation value based on an adjacent group quantization candidate output value and an evaluation value based on the pertinent group quantization value.

Other objects and features will be clarified from the following description with reference to attached drawings.

PREFERRED EMBODIMENTS OF THE INVENTION

In the first aspect of the present invention, an excitation speech is constituted by M non-zero amplitude pulses. An excitation quantizer divides M pulses into groups each of L (L<M) pulses, and for each group the amplitudes of the L pulses are collectively quantized.

M pulses are provided as the excitation signal for each predetermined period of time. The time length is set to N samples. Denoting the amplitude and position of an i-th pulse by $g_i$ and $m_i$, respectively, the excitation signal is expressed as:

$$v(n) = \sum_{i=1}^{M} g_i \delta(n - m_i),\ 0 \le m_i \le N - 1 \tag{1}$$

In the following description, it is assumed that the pulse amplitude is quantized using the amplitude codebook. Denoting a k-th codevector stored in the amplitude codebook represented by $g'_{ik}$ and the pulse amplitudes are quantized at a time by L, the source of speech is given as:

$$v_k(n) = \sum_j \sum_{i=1}^{L_j} g'_{ik} \delta(n - m_i),\ k = 0, \ldots, 2^{B-1} \tag{2}$$

where B is the number of bits of the amplitude codebook.

Using equation (2), the distortion of the reproduced signal and input speech signal is expressed by:

$$D_k = \sum_{n=0}^{N-1} \left[ x_w(n) - G \cdot \sum_j \sum_{i=1}^{L_j} g'_{ik} h_w(n - m_i) \right]^2 \tag{3}$$

where $X_w(n)$, $h_w(n)$ and G are the acoustical sense weight speech signal, the acoustical sense weight impulse response and the excitation gain, respectively, as will be described in the following embodiments.

To minimize equation (3), a combination of a k-th codevector and position $m_i$ which minimizes the equation may be obtained for the pulse group of L. At this time, at least one quantization candidate is selected and outputted by evaluating the stream through addition of the evaluation value based on the quantization candidate output value in an adjacent group and the evaluation value based on the quantization value in the pertinent group.

In the second aspect of the present invention, a plurality of sets of pulse positions are outputted, the amplitudes of L pulses are collectively quantized by executing the same process as according to the first aspect of the present invention for each of position candidates in the plurality of sets, and finally an optimum combination of pulse position and amplitude codevector is selected.

In the third aspect of the present invention, a mode is judged by extracting a feature quantity from speech signal. In a predetermined mode, the excitation signal is constituted by M non-zero amplitude pulses. The amplitudes of L pulses are collectively quantized by executing the same process as according to the second aspect of the present invention for each of position candidates in the plurality of sets, and finally an optimum combination of pulse position and amplitude codevector is selected.

Figure 1:
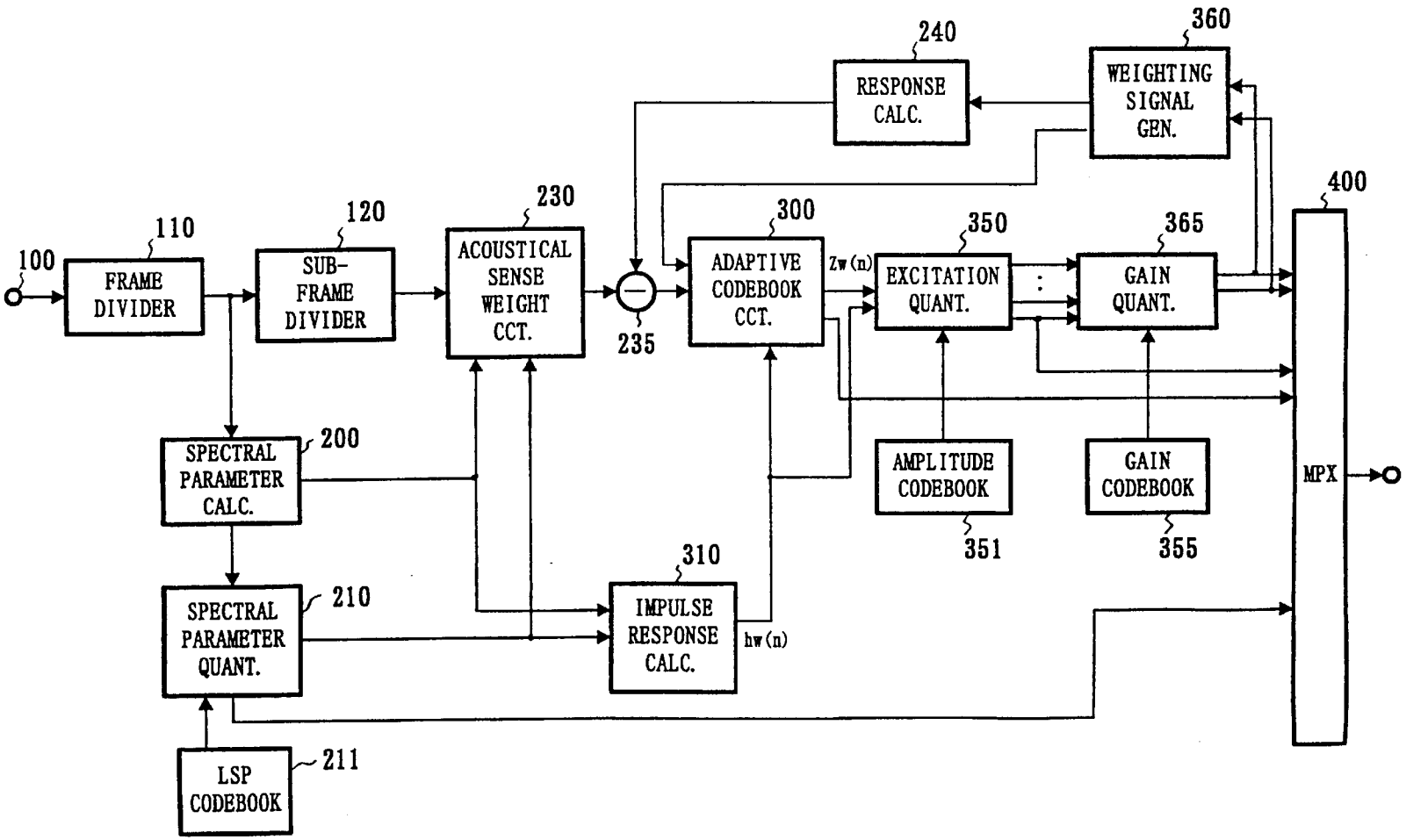
FIG. 1 is a block diagram showing an embodiment of the speech coder according to the present invention.

Now, FIG. 1 is a block diagram showing an embodiment of the speech coder according to the present invention.

Referring to the figure, a frame divider 110 divides a speech signal from an input terminal 100 into frames (of 10 ms, for instance), and a sub-frame divider 120 divides each speech signal frame into sub-frames of a shorter interval (for instance 5 ms).

A spectral parameter calculator 200 calculates spectral parameters of a predetermined order number P (P=10) by cutting out the speech for a window with a greater length than the sub-frame length (for instance 24 ms) with respect to at least one speech signal sub-frame. The spectral parameter may be calculated by using well-known means, for instance LPC analysis or Burg analysis. Burg analysis is used here. The Burg analysis is detailed in Nakamizo, "Signal Analysis and System Identification", Corona-sha, 1988, pp. 82–87 (Literature 4), and not described here. The spectral parameter calculator 200 also converts a linear prediction coefficient $\alpha_i$ (i=1, . . . , 10) calculated through the Burg analysis process into an LSP (line spectrum pair) parameter suited for quantization or interpolation. For the conversion of the linear prediction coefficient into the LSP parameter, Sugamuran et. al, "Speech data compression by LSP speech analysis/synthesis system", Journal of the Society of Electronic Communication Engineers of Japan, J64-A, pp. 599–606, 1981 (Literature 5), may be referred to. For example, the spectral parameter calculator 200 converts the linear prediction coefficient obtained through the Burg analysis process, for instance in the 2-nd sub-frame, into the LSP parameter, obtains the 1-st sub-frame LSB parameter through linear interpolation, inversely converts this 1-st sub-frame LSP parameter back into the linear prediction coefficient, and outputs the linear prediction coefficients $\alpha_{iI}$ (i=1, . . . , 10, I=1, . . . , 2) to an acoustical sense weighting circuit 230, while outputting the 2-nd sub-frame LSP parameter to a spectral parameter quantizer 210.

The spectral parameter quantizer 210 efficiently quantizes the LSP parameter of a predetermined sub-frame and outputs the quantization value which minimizes the distortion expressed as:

$$D_j = \sum_{i}^{P} W(i)[LSP(i) - QLSP(i)_j]^2 \tag{4}$$

where LSP(i), QLSP(i) and W(i) are the i-th sub-frame LSP parameter before quantizing, the quantized result of the i-th sub-frame after the quantizing, and the weighting coefficient in the j-th sub-frame, respectively.

In the following description, it is assumed that the vector quantizing is used as the quantizing process, and that the 2-nd sub-frame LSP parameter is quantized. The vector quantizing of the LSP parameter may be executed by using well-known means. As for specific means, which are not described here, Japanese Laid-Open Patent Publication No. Hei 4-171500 (Japanese Patent Application No. Hei 2-297600, Literature 6), Japanese Laid-Open Patent Publication No. Hei 4-363000 (Japanese Patent Application No. Hei 3-261925, Literature 7), Japanese Laid-Open Patent Publication No. Hei 5-6199 (Japanese Patent Application No. Hei 3-155049, Literature 8), and T. Nomuran et. al, "LSP Coding Using VQSVQ with Interpolation in 4.075 kbps M-LCELP Speech Coder", Proc. Mobile Multimedia Communications, pp. B. 2.5, 1993 (Literature 9), may be referred to.

A spectral parameter quantizer 210 restores the 1-st sub-frame LSP parameter from the quantized LSP parameter in the 2-nd sub-frame. Specifically, the spectral parameter quantizer 210 restores the 1-st sub-frame LSP parameter through the linear interpolation of the quantized 2-nd sub-frame LSP parameter of the prevailing frame and that of the preceding frame. It selects a codevector for minimizing the error power of LSP before and after the quantizing, before it makes the 1-st sub-frame LSP parameter restoration through the linear interpolation.

The spectral parameter quantizer 210 converts the restored the quantized 1-st sub-frame LSP parameter and the 2-nd sub-frame LSP parameter into the linear prediction coefficient $\alpha'_{iI}$ (i=1, . . . , 10, I=1, . . . , 2) for each sub-frame, and outputs the result to an impulse response calculator 310. It also outputs an index representing the 2-nd sub-frame LSP quantization codevector to a multiplexer 400.

The acoustical sense weighting circuit 230 receives the linear prediction coefficient $\alpha_i$(i=1, . . . , P) for each sub-frame from the spectral parameter calculator 200, and acoustical sense weights the speech signal sub-frame to output an acoustical sense weighted signal.

The impulse response calculator 310 receives the linear prediction coefficient $\alpha_i$ for each sub-frame from the spectral parameter calculator 200 and the linear prediction coefficient $\alpha'_i$, obtained through the quantizing, interpolating and restoring, from the spectral parameter quantizer 210, calculates a response signal with the input signal as d(n)=0, using the preserved filter memory values, and outputs the response signal x(n) thus obtained to a subtractor 235. The response signal x (n) is given as:

$$x_z(n) = d(n) - \sum_{i=1}^{P} \alpha_i d(n-i) + \sum_{i=1}^{P} \alpha_i \gamma^i y(n-i) + \sum_{i=1}^{P} \alpha'_i \gamma^i x_z(n-i) \tag{5}$$

where when n−i≦0, $$y(n-i)=p(N+(n-i)) \tag{6}$$

and $$x_z(n-i)=s_w(N+(n-i)) \tag{7}$$

N is the sub-frame length, τ is a weighting coefficient for controlling the extent of the acoustical sense weighting and having the same value as in equation (15) given hereinunder, and $s_w$(n) and p(n) are the output signal of an weighting signal calculator, and the output signal represented by the filter divisor in the right side first term of equation (15).

The subtractor 235 subtracts the response signal from the acoustical sense weighting signal as:

$$x'_w(n)=x_w(n)-x_z(n) \tag{8}$$

for one sub-frame, and outputs the result $x_w$(n) to an adaptive codebook circuit 300.

The impulse response calculator 310 calculates the impulse response $h_w$(n) of the acoustical sense weighting filter executes the following z transform:

$$H_w(z) = \frac{1 - \sum_{i=1}^{P} \alpha_i z^{-1}}{1 - \sum_{i=1}^{P} \alpha_i \gamma^i z^{-i}} \frac{1}{1 - \sum_{i=1}^{P} \alpha'_i \gamma^i z^{-i}} \tag{9}$$

for a predetermined number L of points, and outputs the result to the adaptive codebook circuit 300 and also to an excitation quantizer 350.

The adaptive codebook circuit 300 receives the past excitation signal v(n) from the weighting signal calculator 360, the output signal $x'_w$(n) from the subtractor 235 and the acoustical sense weighted impulse response $h_w$(n) from the impulse response calculator 310, determines a delay T corresponding to the pitch such as to minimize the distortion $$D_T = \sum_{n=0}^{N-1} x'^2_w(n) - \left[\sum_{n=0}^{N-1} x'_w(n) y_w(n-T)\right]^2 \Big/ \left[\sum_{n=0}^{N-1} y^2_w(n-T)\right] \tag{10}$$

where $$y_w(n-T)=v(n-T)*h_w(n) \tag{11}$$

where the symbol * represents convolution. The circuit 300 outputs an index representing the delay to the multiplexer 400. It also obtains the gain β as:

$$\beta = \sum_{n=0}^{N-1} x'_w(n) y_w(n-T) \Big/ \sum_{n=0}^{N-1} y^2_w(n-T) \tag{12}$$

In order to improve the delay extraction accuracy for women's speeches and children's speeches, the delay may be obtained as decimal sample values rather than integer samples. For a specific process, P. Kroon et. al, "Pitch predictors with high temporal resolution", Proc. ICASSP, 1990, pp. 661–664 (Literature 10), for instance, may be referred to.

The adaptive codebook circuit 300 makes the pitch prediction as:

$$z_w(n)=x'_w(n)-\beta v(n-T)*h_w(n) \tag{13}$$

and outputs the prediction error signal $z_w$(n) to the excitation quantizer 350.

The excitation quantizer 350 provides M pulses as described before in connection with the function.

In the following description, it is assumed that for collectively quantizing the pulse amplitudes for L (L<M) pulses a B-bit amplitude codebook is provided, which is shown as an amplitude codebook 351.

Figure 2:
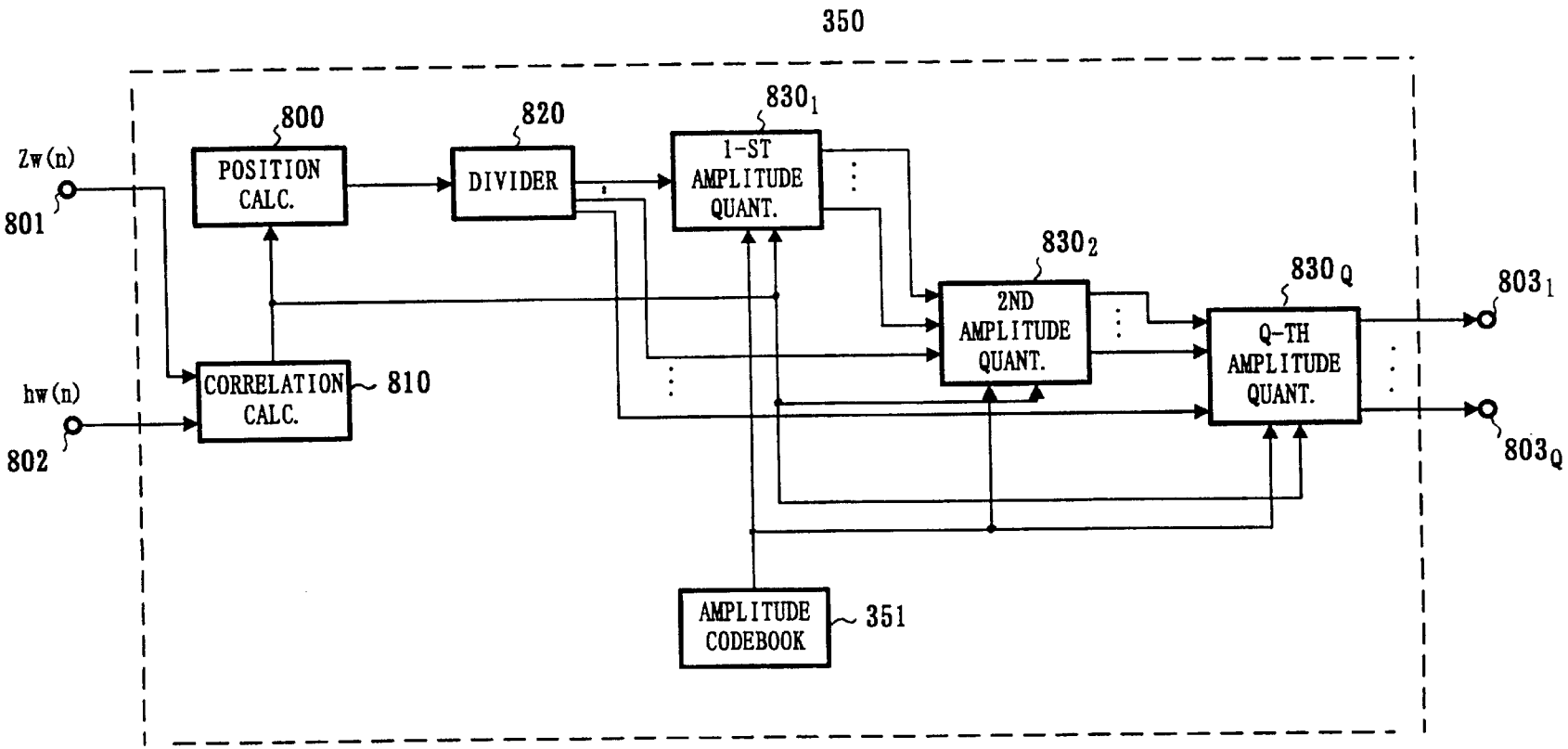
FIG. 2 is a block diagram of the excitation quantizer 350 in FIG. 1.

The excitation quantizer 350 has a construction as shown in the block diagram of FIG. 2.

As shown in FIG. 2, a correlation calculator 810, receiving $z_w(n)$ and $h_w(n)$ from terminals 801 and 802, calculates two kinds of correlation coefficients d(n) and ϕ as:

$$d(n) = \sum_{i=n}^{N-1} z(i)h_w(i-n),\ n = 0, \ldots, N-1 \tag{14}$$

$$\phi(p, q) = \sum_{n=\max(p,q)}^{N-1} h_w(n-p)h_w(n-q),\ p, q = 0, \ldots, N-1 \tag{15}$$

and outputs these correlation coefficients to a position calculator 800 and amplitude quantizers $\mathbf{830}_1$ to $\mathbf{830}_Q$.

The position calculator 800 calculates the positions of non-zero amplitude pulses corresponding in number to the predetermined number M. This operation is executed as in Literature 3. Specifically, for each pulse a position thereof which maximizes an equation given below is determined among predetermined position candidates.

For example, where the sub-frame length is N=40 and the pulse number is M=5, an example position candidates is given as:

| |
|---|
| 0, 5, 10, 15, 20, 25, 30, 35 |
| 1, 6, 11, 16, 21, 26, 31, 36 |
| 2, 7, 12, 17, 22, 27, 32, 37 |
| 3, 8, 13, 18, 23, 28, 33, 38 |
| 4, 9, 14, 19, 24, 29, 34, 39 |

For each pulse, these position candidates are checked to select a position which maximizes an equation:

$$D = \frac{C_k^2}{E_k} \tag{16}$$

$$C_k = \sum_{k=1}^{M} \mathrm{sgn}(k)d(m_k) \tag{17}$$

$$E = \sum_{k=1}^{M} \mathrm{sgn}(k)^2\phi(m_k, m_k) + 2\sum_{k=1}^{M-1}\sum_{i=k+1}^{M} \mathrm{sgn}(k)\mathrm{sgn}(i)\phi(m_k, m_i) \tag{18}$$

Symbols sgn(k) and sgn(i) represent the polarity of pulse positions $m_k$ and $m_i$. The position calculator 800 outputs position data of the M pulses to a divider 820.

The divider 820 divides the M pulses into groups each of L pulses. The number U of groups is $$U=M/L.$$

The amplitude quantizes $\mathbf{830}_1$ to $\mathbf{830}_Q$ quantize the amplitude of L pulses each using the amplitude codebook 351. The deterioration due to the amplitude quantizing by dividing the pulses is reduced as much as possible as follows. The 1-st amplitude quantizer $\mathbf{830}_1$ outputs a plurality of (i.e., Q) amplitude codevector candidates in the order of maximizing the following equation:

$$C_j^2/E_j \tag{19}$$

where $$C_j = \sum_{k=1}^{L} g'_{kj}d(m_k) \tag{20}$$

$$E_j = \sum_{k=1}^{L} g'^2_{kj}\phi(m_k, m_k) + 2\sum_{k=1}^{L-1}\sum_{i=k+1}^{L} g'_{kj}g'_{ij}(m_k, m_i) \tag{21}$$

The 2-nd amplitude quantizer $\mathbf{830}_2$ calculates equations:

$$C_j = \sum_{l=1}^{L} g'_l d(m_l) + \sum_{k=L+1}^{2L} g'_{kj}(m_k) \tag{22}$$

$$E_j = \sum_{l=1}^{L} g'^2_l\phi(m_l, m_l) + 2\sum_{l=1}^{L-1}\sum_{i=l+1}^{L} g'_l g'_i\phi(m_l, m_i) + \sum_{k=L+1}^{2L} g'^2_{kj}\phi(m_k, m_k) + 2\sum_{k=L+1}^{2L-1}\sum_{i=k+1}^{2L} g'_{kj}g'_{ij}\phi(m_k, m_i) \tag{23}$$

through addition of an evaluation value of each of Q quantization candidates of the first amplitude quantizer $\mathbf{830}_1$ and an evaluation value based on the amplitude quantization values of the L pulses of the 2-nd group.

Then, Q codevectors are outputted in the order of maximizing the evaluation value given as:

$$C_j^2/E_j \tag{24}$$

The 3-rd amplitude quantizer $\mathbf{830}_3$ calculates evaluation values given as:

$$C_j = \sum_{l=1}^{2L} g'_l d(m_l) + \sum_{k=2L+1}^{3L} g'_{kj}d(m_k) \tag{25}$$

$$E_j = \sum_{l=1}^{2L} g'^2_l\phi(m_l, m_l) + 2\sum_{l=1}^{2L-1}\sum_{i=l+1}^{2L} g'_l g'_i\phi(m_l, m_i) + \sum_{k=2L+1}^{3L} g'^2_{kj}\phi(m_k, m_k) + 2\sum_{k=2L+1}^{3L-1}\sum_{i=k+1}^{3L} g'_{kj}g'_{ij}\phi(m_k, m_i) \tag{26}$$

through addition of the evaluation value of each of Q quantization candidates the 2-nd amplitude quantizer $\mathbf{830}_2$ and an evaluation value based on the amplitude quantization values of the L pulses of the 3-rd group.

Then, Q codevectors for maximizing the evaluation value given as:

$$C_j^2/E_j \tag{27}$$

are outputted from each of terminals $\mathbf{803}_1$ to $\mathbf{830}_Q$.

Referring to FIG. 1, the pulse position is quantized with a predetermined number of bits, and an index representing the position is outputted to the multiplexer.

For the pulse position search, the process described in Literature 3 or, for instance, K. Ozawa, "A study on pulse search algorithm for multipulse excited speech coder realization" (Literature 11), may be referred to.

It is possible to preliminarily study and store a codebook for quantizing the amplitudes of a plurality of pulses by using a speech signal. For the codebook study, Linde et. al, "An algorithm for vector quantization design", IEEE Trans. Commun., pp. 84–95, January 1980 (Literature 12), for instance, may be referred to.

The position data and Q different amplitude codevector indexes are outputted to a gain quantizer 365.

The gain quantizer 365 reads out a gain codevector from a gain codebook 355, then selects one of Q amplitude codevectors that minimizes the following equation for a selected position, and finally selects an amplitude codevector and a gain codevector combination which minimizes the distortion.

In this example, both the adaptive codebook gain and pulse-represented excitation gain are simultaneously vector quantized. The equation mentioned above is:

$$D_t = \sum_{n=0}^{N-1}\left[x_w(n) - \beta'_t v(n-T) * h_w(n) - G'_t \sum_{i=1}^{M} g'_{ik} h_w(n-m_i)\right]^2 \tag{28}$$

where $\beta'_t$ and $G'_t$ represent a k-the codevector in a two-dimensional gain codebook stored in the gain codebook 355. The above calculation is executed repeatedly for each of the Q amplitude codevectors, thus selecting the combination for minimizing the distortion $D_t$.

The selected gain and amplitude codevector indexes are outputted to the multiplexer 400.

The weighting signal calculator 360 receives these indexes, reads out the codevectors corresponding thereto, and obtains a drive excitation signal v(n) according to the following equation:

$$v(n) = \beta'_t v(n-T) + G'_t \sum_{i=1}^{M} g'_{ik}\delta(n-m_i) \tag{29}$$

The weighting signal calculator 360 outputs the calculated drive excitation signal v(n) to the adaptive codebook circuit 300.

Then, it calculates the response signal $s_w(n)$ for each sub-frame by using the output parameters of the spectral parameter calculator 200 and the spectral parameter quantizer 210 according to the following equation:

$$s_w(n) = v(n) - \sum_{i=1}^{P} a_i v(n-i) + \sum_{i=1}^{P} a_i \gamma^i p(n-i) + \sum_{i=1}^{P} a'_i \gamma^i s_w(n-i) \tag{30}$$

and outputs the calculated response signal $s_w(n)$ to the response signal calculator 240.

The description so far has concerned with a first embodiment of the present invention.

Figure 3:
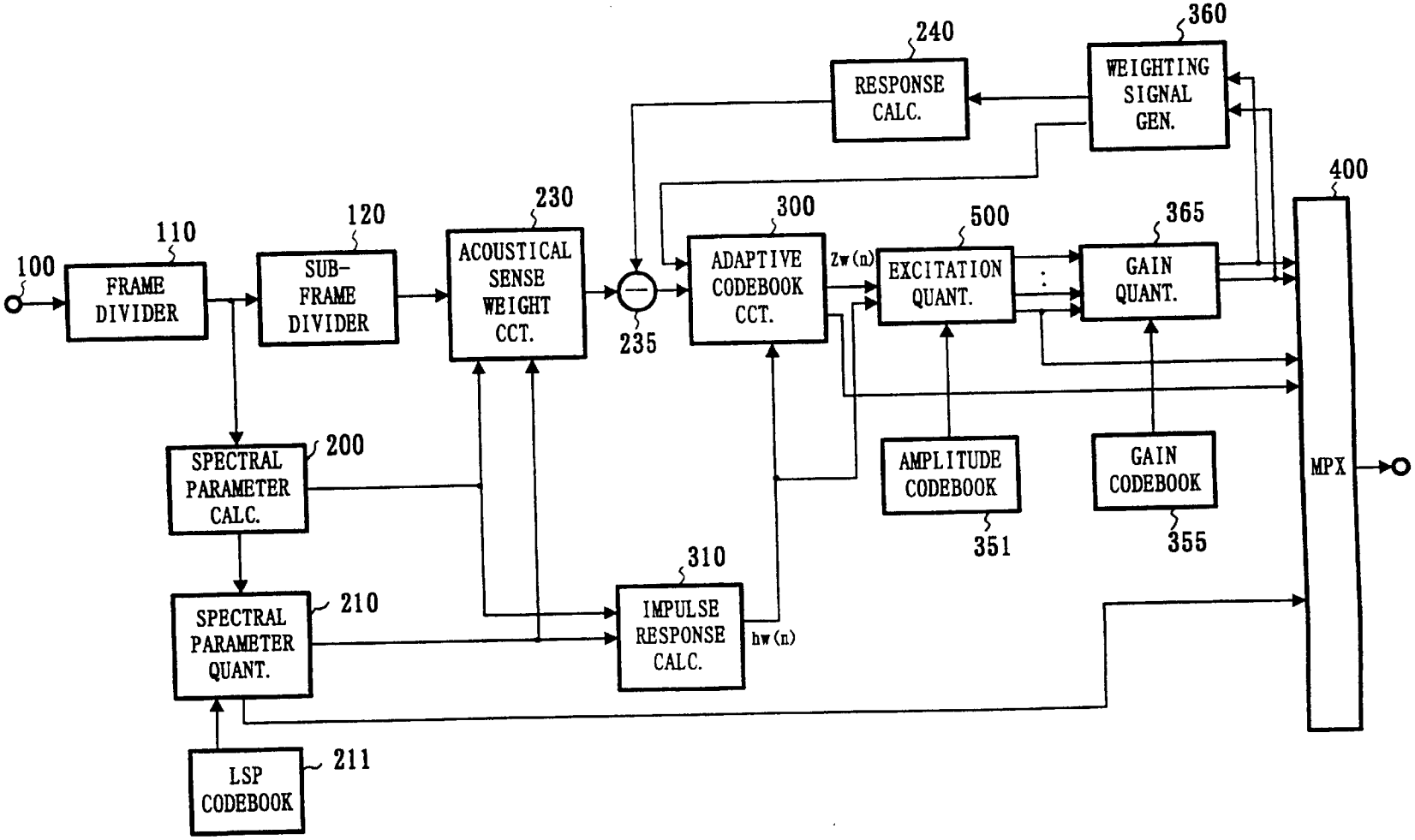
FIG. 3 is a block diagram showing a second embodiment of the present invention.

FIG. 3 is a block diagram showing a second embodiment of the present invention.

This embodiment is different from the preceding embodiment in the operation of the excitation quantizer 500. The construction of the excitation quantizer 500 is shown in FIG. 4.

Figure 4:
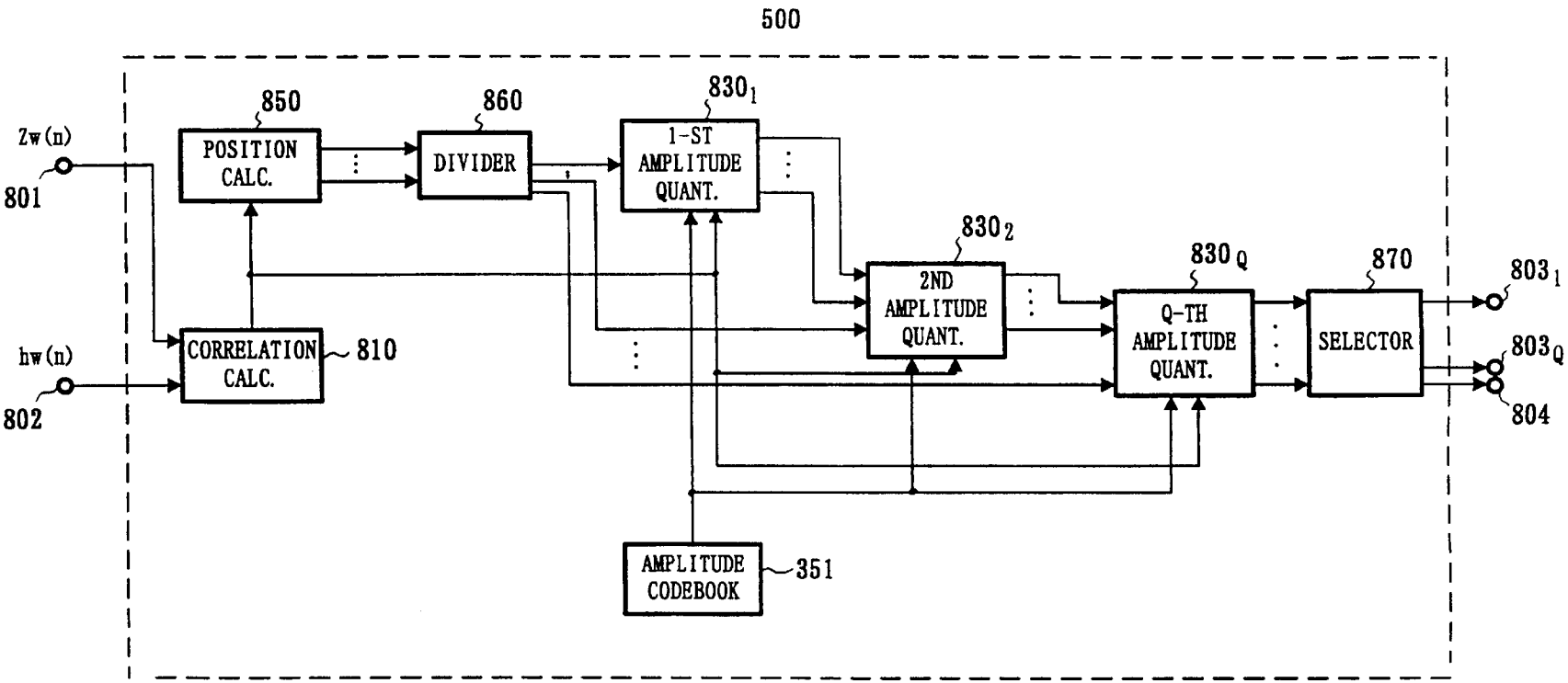
FIG. 4 is a block diagram of the excitation quantizer 500 in FIG. 3.

Referring to FIG. 4, the position calculator 850 outputs a plurality of (for instance Y) sets of position candidates in the order of maximizing the equation (16) to the divider 860.

The divider 860 divides M pulses into groups each of L pulses, and outputs the Y sets of position candidates for each group.

The amplitude quantizers $\mathbf{830}_1$ to $\mathbf{830}_Q$ each obtains Q amplitude codevector candidates for each of the position candidates of L pulses in the manner as described before in connection with FIG. 2, and outputs these amplitude vector candidates to the next one.

A selector 870 obtains the distortion of the entirety of the M pulses for each position candidate, selects a position candidate which minimizes the distortion, and outputs Q different amplitude code vectors and selected position data.

Figure 5:
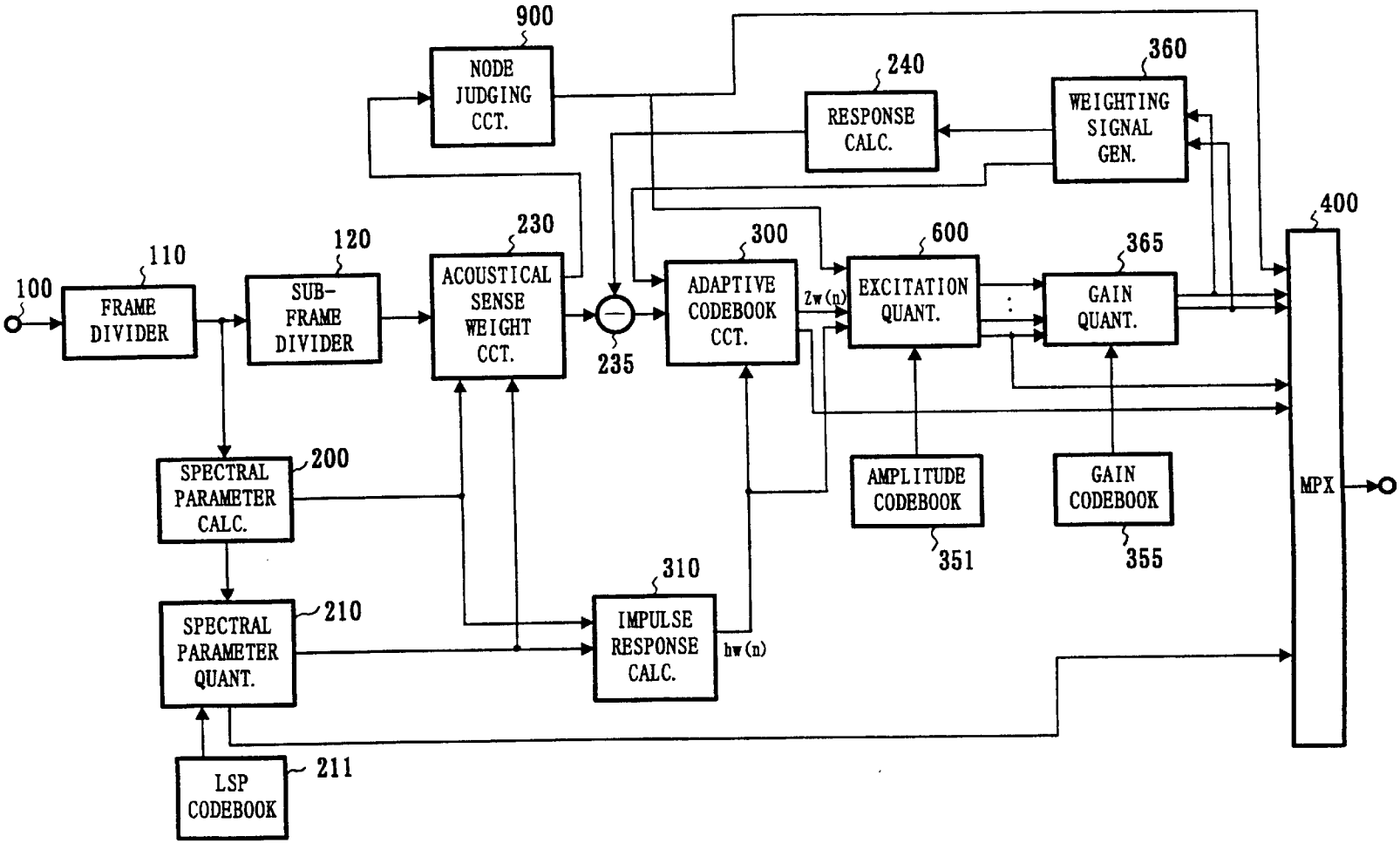
FIG. 5 is a block diagram showing a third embodiment of the present invention.

FIG. 5 is a block diagram showing a third embodiment of the present invention.

A mode judging circuit 900, which receives the acoustical sense weighting signal for each frame from the acoustical sense weighting circuit 230, and outputs mode judgment data to an excitation quantizer 600. The mode judgment in this case is made by using the feature quantity of the prevailing frame. The feature quantity may be the frame average pitch prediction gain. The pitch prediction gain may be calculated by using an equation:

$$G = 10\log_{10}\left[1/L\sum_{i=1}^{L}(P_i/E_i)\right] \tag{31}$$

where L is the number of sub-frames in one frame, and $P_i$ and $E_i$ the speech power and the pitch prediction error power, respectively, of the i-th sub-frame given as:

$$P_i = \sum_{n=0}^{N-1} x_{wi}^2(n) \tag{32}$$

$$E_i = P_i - \left[\sum_{n=0}^{N-1} x_{wi}(n)x_{wi}(n-T)\right]^2 \Big/ \left[\sum_{n=0}^{N-1} x_{wi}^2(n-T)\right] \tag{33}$$

where T is the optimum delay for maximizing the pitch prediction gain.

The frame mean pitch prediction gain G is compared to a plurality of predetermined threshold values for classification into a plurality of, for instance four, different modes. The mode judging circuit 900 outputs mode data to the excitation quantizer 600 and also to the multiplexer 400.

Figure 6:
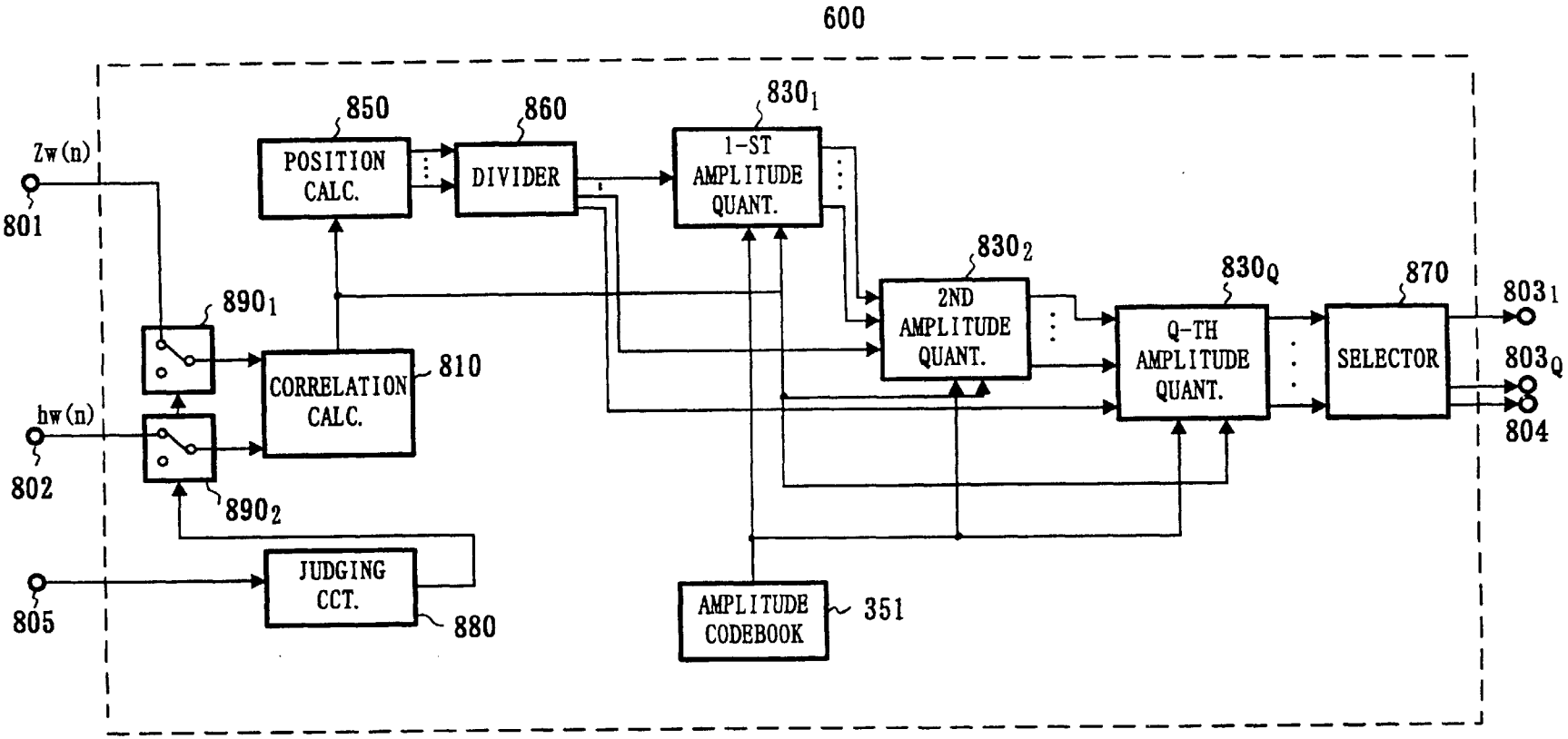
FIG. 6 is a block diagram of the excitation quantizer 600 in FIG. 5.

The excitation quantizer 600 has a construction as shown in FIG. 6. A judging circuit 880 receives the mode data from a terminal 805, and checks whether the mode data represents a predetermined mode. In this case, the same operation as in FIG. 4 is performed by exchanging switch circuits $\mathbf{890}_1$ and $\mathbf{890}_2$ to the upper side.

While some preferred embodiments of the present invention have been described, they are by no means limitative, and they may be variously modified.

For example, the adaptive codebook circuit and the gain codebook may be constructed such that they are switchable according to the mode data.

The pulse amplitude quantizing may be executed by using a plurality of codevectors which are preliminarily selected from the amplitude codebook for each group of L pulses. This process permits reducing the computational effort required for the amplitude quantizing.

As an example of the preliminary selection, the plurality of different amplitude codevectors may be preliminarily selected and outputted to the excitation quantizer in the order of maximizing equation (34) or (35).

$$D_k = \left[\sum_{n=0}^{N-1} z(n)\sum_{i=1}^{L} g'_{ik}\delta(m_i)\right]^2 \tag{34}$$

$$D_k = \left[\sum_{n=0}^{N-1} z(n)\sum_{i=1}^{L} g'_{ik}\delta(m_i)\right]^2 \Big/ \left[\sum_{i=1}^{L} g'_{ik}\delta(m_i)\right]^2 \tag{35}$$

As has been described in the foregoing, the excitation quantizer divides M non-zero amplitude pulses of an excitation into groups each of L pulses less than M pulses and, when collectively quantizing the amplitude of L pulses, selects and outputs at least one quantization candidate by evaluating the distortion through addition of together the evaluation value based on an adjacent group quantization candidate output value and the evaluation value based on the pertinent group quantization value. It is thus possible to quantize the amplitude of pulses with a relatively less computational effort.

According to the present invention, with the above construction the amplitude is quantized for each of the pulse positions in a plurality of sets, and finally a combination of an amplitude codevector and a position set which minimizes the distortion is selected. It is thus possible to greatly improve the performance of the pulse amplitude quantizing.

According to the present invention, a mode is judged from the speech of a frame, and the above operation is executed in a predetermined mode. In other words, an adaptive process may be carried out in dependence on the feature of speech, and it is possible to improve the speech quality compared to the prior art system.

Changes in construction will occur to those skilled in the art and various apparently different modifications and embodiments may be made without departing from the scope of the present invention. The matter set forth in the foregoing description and accompanying drawings is offered by way of illustration only. It is therefore intended that the foregoing description be regarded as illustrative rather than limiting.

What is claimed:

1. A speech coder, comprising:

a spectral parameter calculator obtaining a spectral parameter from an input speech signal and quantizing the spectral parameter;

a divider diving M non-zero amplitude pulses of an excitation signal of the speech signal into groups, each of said groups of pulses having a number of pulses fewer than M; and an excitation quantizer calculating the positions of the pulses in each of said groups and simultaneously quantizing the amplitudes of the pulses using the spectral parameter, selecting and outputting at least one quantization candidate by evaluating distortion through addition of; (1) the evaluation value based on an adjacent group quantization candidate output value, and (2) the evaluation value based on the pertinent group quantization value, and encoding the speech signal using the selected quantization candidate.

2. The speech coder as set forth in claim 1, wherein the pulse amplitude quantizing is executed by using a plurality of codevectors which are preliminarily selected from the amplitude codebook for each group.

3. A speech coder, comprising;

a spectral parameter calculator obtaining a spectral parameter from an input speech signal and quantizing the spectral parameter;

a divider dividing M non-zero amplitude pulses of an excitation signal into groups of pulses, each of said groups of pulses having fewer than M pulses; and an excitation quantizer:

calculating a plurality of sets of positions of the pulses in each group and, simultaneously, quantizing the amplitudes of the pulses in each group using a codebook and the spectral parameter, and selecting at least one quantization candidate by evaluating distortion through addition of the evaluation value based on an adjacent group quantization candidate output value and the evaluation value based on the pertinent group quantization value, thereby selecting a combination of a position set and a codevector for quantizing the speech signal.

4. The speech coder as set forth in claim 3, wherein the pulse amplitude quantizing is executed by using a plurality of codevectors which are preliminarily selected from the amplitude codebook for each group.

5. A speech coder, comprising:

a spectral parameter calculator obtaining a spectral parameter from an input speech signal for every determined period of time and quantizing the spectral parameter;

a mode judging unit judging a mode by extracting a feature quantity from the speech signal;

a divider dividing M non-zero amplitude pulses of an excitation signal into groups of fewer than M pulses; and an excitation quantizer calculating a plurality of sets of positions of the pulses in each group and, simultaneously, quantizing the amplitudes of the pulses in each group using a codebook and the spectral parameter, and selecting at least one quantization candidate by evaluating the distortion through addition of the evaluation value based on an adjacent group quantization candidate output value and the evaluation value based on the pertinent group quantization value, thereby selecting a combination of position set and a codevector for quantizing the speech signals.

6. The speech coder as set forth in claim 5, wherein the pulse amplitude quantizing is executed by using a plurality of codevectors which are preliminarily selected from the amplitude codebook for each group.

7. A speech coding method, comprising:

dividing M non-zero amplitude pulses of an excitation signal of an input speech signal into pulse groups L pulses each, L being less than M, collectively quantizing the amplitudes of said L pulses, selecting at least one quantization candidate by evaluating distortion through addition of an evaluation value based on an adjacent group quantization candidate output value, and an evaluation value based on the pertinent group quantization value, and outputting the quantization candidate.

* * * * *

UNITED STATES PATENT AND TRADEMARK OFFICE

CERTIFICATE OF CORRECTION

PATENT NO. : 6,023,672

DATED : February 8, 2000

INVENTOR(S) : Kazunori OZAWA

It is certified that error appears in the above-indentified patent and that said Letters Patent is hereby corrected as shown below:

Column 8, line 7, equation 21, after "$g_{ij}$" insert --∅--;

line 53, delete "$830_Q$" and insert therefor --$803_Q$--.

Signed and Sealed this

Twenty-seventh Day of March, 2001

Nicholas P. Godici

*Attest:*

NICHOLAS P. GODICI

*Acting Director of the United States Patent and Trademark Office*

*Attesting Officer*